US010951999B2

(12) United States Patent
Fransen et al.

(10) Patent No.: US 10,951,999 B2
(45) Date of Patent: Mar. 16, 2021

(54) ASSEMBLY OF A RECEIVER AND A MICROPHONE

(71) Applicant: Sonion Nederland B.V., Hoofddorp (NL)

(72) Inventors: Alwin Fransen, Hoofddorp (NL); Nicolaas Maria Jozef Stoffels, Hoofddorp (NL); Paul Christiaan van Hal, Hoofddorp (NL); Sietse Jacob Van Reeuwijk, Hoofddorp (NL); Raymond Mögelin, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/284,171

(22) Filed: Feb. 25, 2019

(65) Prior Publication Data

US 2019/0268709 A1 Aug. 29, 2019

(30) Foreign Application Priority Data

Feb. 26, 2018 (EP) ..... 18158574
Sep. 19, 2018 (EP) ..... 18195529

(51) Int. Cl.

| | |
|---|---|
| ***H04R 25/00*** | (2006.01) |
| ***H04R 1/08*** | (2006.01) |
| *H04R 1/10* | (2006.01) |
| *H04R 1/06* | (2006.01) |

(52) U.S. Cl.
CPC ..... *H04R 25/604* (2013.01); *H04R 1/08* (2013.01); *H04R 25/65* (2013.01); *H04R 1/06* (2013.01); *H04R 1/1075* (2013.01)

(58) Field of Classification Search
CPC ..... H04R 25/604; H04R 1/08; H04R 25/65; H04R 1/06; H04R 1/1075
USPC ..... 381/324
See application file for complete search history.

(56) References Cited

U.S. PATENT DOCUMENTS

| | | | |
|---|---|---|---|
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |

(Continued)

FOREIGN PATENT DOCUMENTS

| | | |
|---|---|---|
| EP | 3073765 A1 | 9/2016 |
| JP | S63-208342 A | 8/1988 |

(Continued)

OTHER PUBLICATIONS

Extended European Search Report for Application No. EP 18158574.6, dated Aug. 16, 2018 (4 pages).

*Primary Examiner* — Phylesha Dabney
(74) *Attorney, Agent, or Firm* — Nixon Peabody LLP

(57) ABSTRACT

An assembly of a receiver and a microphone, such as for positioning in an ear canal of a person. The receiver and microphone are provided in an overlapping relationship to take up less space while being able to emit sound in one direction and receive sound from that direction. When the assembly if for use deep inside the ear canal of a person, the microphone may be very small, as it is exposed to very high sound levels.

20 Claims, 2 Drawing Sheets

(56) References Cited

U.S. PATENT DOCUMENTS

| | | | |
|---|---|---|---|
| 6,943,308 | B2 | 9/2005 | Ravnkilde |
| 6,974,921 | B2 | 12/2005 | Jorgensen |
| 7,008,271 | B2 | 3/2006 | Jorgensen |
| 7,012,200 | B2 | 3/2006 | Moller |
| 7,062,058 | B2 | 6/2006 | Steeman |
| 7,062,063 | B2 | 6/2006 | Hansen |
| 7,072,482 | B2 | 7/2006 | Van Doorn |
| 7,088,839 | B2 | 8/2006 | Geschiere |
| 7,110,560 | B2 | 9/2006 | Stenberg |
| 7,136,496 | B2 | 11/2006 | van Halteren |
| 7,142,682 | B2 | 11/2006 | Mullenborn |
| 7,181,035 | B2 | 2/2007 | van Halteren |
| 7,190,803 | B2 | 3/2007 | van Halteren |
| 7,206,428 | B2 | 4/2007 | Geschiere |
| 7,221,767 | B2 | 5/2007 | Mullenborn |
| 7,221,769 | B1 | 5/2007 | Jorgensen |
| 7,227,968 | B2 | 6/2007 | van Halteren |
| 7,239,714 | B2 | 7/2007 | de Blok |
| 7,245,734 | B2 | 7/2007 | Niederdraenk |
| 7,254,248 | B2 | 8/2007 | Johannsen |
| 7,286,680 | B2 | 10/2007 | Steeman |
| 7,292,700 | B1 | 11/2007 | Engbert |
| 7,292,876 | B2 | 11/2007 | Bosh |
| 7,336,794 | B2 | 2/2008 | Furst |
| 7,376,240 | B2 | 5/2008 | Hansen |
| 7,403,630 | B2 | 7/2008 | Jorgensen |
| 7,415,121 | B2 | 8/2008 | Mögelin |
| 7,425,196 | B2 | 9/2008 | Jorgensen |
| 7,460,681 | B2 | 12/2008 | Geschiere |
| 7,466,835 | B2 | 12/2008 | Stenberg |
| 7,492,919 | B2 | 2/2009 | Engbert |
| 7,548,626 | B2 | 6/2009 | Stenberg |
| 7,657,048 | B2 | 2/2010 | van Halteren |
| 7,684,575 | B2 | 3/2010 | van Halteren |
| 7,706,561 | B2 | 4/2010 | Wilmink |
| 7,715,583 | B2 | 5/2010 | Van Halteren |
| 7,728,237 | B2 | 6/2010 | Pedersen |
| 7,747,032 | B2 | 6/2010 | Zei et al. |
| 7,809,151 | B2 | 10/2010 | Van Halteren |
| 7,822,218 | B2 | 10/2010 | Van Halteren |
| 7,899,203 | B2 | 3/2011 | Van Halteren |
| 7,912,240 | B2 | 3/2011 | Madaffari |
| 7,946,890 | B1 | 5/2011 | Bondo |
| 7,953,241 | B2 | 5/2011 | Jorgensen |
| 7,961,899 | B2 | 6/2011 | Van Halteren |
| 7,970,161 | B2 | 6/2011 | van Halteren |
| 7,995,782 | B2 | 8/2011 | Saltykov |
| 8,098,854 | B2 | 1/2012 | van Halteren |
| 8,101,876 | B2 | 1/2012 | Andreasen |
| 8,103,039 | B2 | 1/2012 | van Halteren |
| 8,160,290 | B2 | 4/2012 | Jorgensen |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman |
| 8,233,652 | B2 | 7/2012 | Jorgensen |
| 8,259,963 | B2 | 9/2012 | Stenberg |
| 8,259,976 | B2 | 9/2012 | van Halteren |
| 8,259,977 | B2 | 9/2012 | Jorgensen |
| 8,280,082 | B2 | 10/2012 | van Halteren |
| 8,284,966 | B2 | 10/2012 | Wilk |
| 8,313,336 | B2 | 11/2012 | Bondo |
| 8,315,422 | B2 | 11/2012 | van Halteren |
| 8,331,595 | B2 | 12/2012 | van Halteren |
| 8,369,552 | B2 | 2/2013 | Engbert |
| 8,379,899 | B2 | 2/2013 | van Halteren |
| 8,509,468 | B2 | 8/2013 | van Halteren |
| 8,526,651 | B2 | 9/2013 | Lafort |
| 8,526,652 | B2 | 9/2013 | Ambrose |
| 9,106,999 | B2 | 8/2015 | Darlington |
| 9,654,854 | B2 | 5/2017 | Darlington et al. |
| 2003/0165249 | A1 | 9/2003 | Higuchi |
| 2009/0103704 | A1 | 4/2009 | Kitada et al. |
| 2011/0182453 | A1 | 7/2011 | van Hal |
| 2011/0189880 | A1 | 8/2011 | Bondo |
| 2011/0299708 | A1 | 12/2011 | Bondo |
| 2011/0299712 | A1 | 12/2011 | Bondo |
| 2011/0311069 | A1 | 12/2011 | Ambrose |
| 2012/0014548 | A1 | 1/2012 | van Halteren |
| 2012/0027245 | A1 | 2/2012 | van Halteren |
| 2012/0140966 | A1 | 6/2012 | Mocking |
| 2012/0155683 | A1 | 6/2012 | van Halteren |
| 2012/0155694 | A1 | 6/2012 | Reeuwijk |
| 2012/0255805 | A1 | 10/2012 | van Halteren |
| 2013/0028451 | A1 | 1/2013 | de Roo |
| 2013/0090931 | A1* | 4/2013 | Ghovanloo ..... A61F 4/00 704/275 |
| 2013/0136284 | A1 | 5/2013 | van Hal |
| 2013/0142370 | A1 | 6/2013 | Engbert |
| 2013/0163799 | A1 | 6/2013 | Van Halteren |
| 2013/0195295 | A1 | 8/2013 | van Halteren |
| 2015/0237429 | A1 | 8/2015 | Ryan |

FOREIGN PATENT DOCUMENTS

| | | | |
|---|---|---|---|
| JP | S63-269850 | A | 11/1988 |
| JP | 2007-267045 | A | 10/2007 |

* cited by examiner

ASSEMBLY OF A RECEIVER AND A MICROPHONE

CROSS-REFERENCE TO RELATED APPLICATIONS

This application claims the benefit of European Patent Application Serial No. 18158574.6, filed Feb. 26, 2018 and European Patent Application Serial No. 18195529.5, filed Sep. 19, 2018, both of which are incorporated herein by reference in their entireties.

FIELD OF THE INVENTION

The present invention relates to an assembly of a receiver and a microphone, primarily for use in a direction toward the inner ear of a person. The receiver may be directed to emit sound toward the eardrum and the inner ear, where the microphone thus may be used for detecting the sound at the ear drum or in the inner ear. Assemblies of this type are rather special in that they cannot take up too much space and the microphone in that situation will act in the presence of a very high sound level.

BACKGROUND OF THE INVENTION

Relevant solutions may be seen in U.S. Pat. No. 7,747,032, U.S. 2015237429, U.S. Pat. No. 7,995,782, EP3073765, U.S. Pat. Nos. 9,106,999 and 9,654,854.

In a first aspect, the invention relates to an assembly comprising a receiver and a sensor, wherein:

- the receiver comprises:
  - a receiver housing,
  - a receiver diaphragm defining, with an inner surface of the receiver housing, a first chamber in the receiver housing having a sound output, and a second chamber in the receiver housing,
- the sensor comprises a sensor housing being at least partially inside the second chamber, and
- the sensor housing or its portion inside the second chamber, having a volume not exceeding 20% of a volume of the second chamber.

The features of this aspect may be combined with any features of the aspects of the invention may be combined. Thus, the receiver, housing, diaphragm, chambers and the like are defined further below.

In one embodiment, the sensor is a microphone.

In a second aspect, the invention relates to an assembly comprising a sensor and a receiver, wherein:

- the receiver comprises:
  - a receiver housing with a receiver housing wall part comprising a sound output,
  - a receiver diaphragm defining, with an inner surface of the receiver housing, a first chamber in the receiver housing,
- the sensor comprises a sensor housing,
- the receiver housing wall part and the microphone housing wall part are at least substantially parallel,
- the receiver housing and microphone housing overlap at least partly when projected on to a first plane, and
- the receiver housing and microphone housing overlap at least partly when projected on to a second plane perpendicular to the first plane.

In this context, an assembly of a sensor and a receiver may, in addition to the sensor and receiver, comprise also other elements such as amplifiers, processors, battery or the like. The sensor and receiver may be attached to each other or not. In one situation, the sensor is provided inside the receiver.

SUMMARY OF INVENTION

The sensor may be a vibration sensor or a sensor for determining other parameters. A vibration sensor may be a voice pickup sensor (sensing voice transported as vibration through the receiver housing), an acceleration sensor, a humidity sensor, a pressure sensor or the like. A preferred sensor type is a microphone. The sensor, and thus the microphone, may be based on any technology, such as a moving magnet technology, an electret technology, MEMS technology or a technology where deformation of an element detects sound/vibration such as a piezo technology. The sensor preferably is configured to output a signal, such as an electrical signal. If sound or a vibration is sensed, the output may be an electrical signal corresponding to the sound/vibration sensed. "Corresponding to" may be the signal output having the same frequency contents at least within a desired frequency range. Naturally, the output may be analogue or digital, so that the "corresponding" may also be numeral values which may be interpreted to arrive at a signal with the desired or sensed frequency components.

A receiver is a sound generator and may also be based on any desired technology, such as moving magnet, moving coil, balanced armature, electret technology, MEMS technology, piezo technology or the like. The receiver is preferably configured to receive a signal, such as an electrical signal, and output a sound or vibration with corresponding frequency contents, at least within a desired frequency interval.

Preferably, the receiver is a miniature receiver, such as a sound generator with a largest dimension of no more than 10 mm, such as no more than 8 mm, such as no more than 6 mm or no more than 5 mm. In one situation, the sound generator housing may have a volume of no more than 100 mm3, such as no more than 70 mm3, such as no more than 50 mm3, such as no more than 30 mm3. Miniature sound generators may be used in hearing aids, hearables or personal hearing devices, such as ear phones or the like.

The receiver has a diaphragm defining, with an inner surface of the receiver housing, the first chamber in the receiver housing. Often, another chamber is defined at least partly by the other side of the diaphragm and the inner surface of the housing. The sound output often extends from inside of the receiver housing and to the outside thereof, such as from the first and/or other chamber, so that sound generated by the diaphragm may escape the receiver housing via the sound output.

The sound output is provided in a housing wall part of the receiver housing, typically a flat or plane wall part of the receiver housing.

Usually, a diaphragm is flat or plane or at lest extends in a plane, which is defined as the first plane. The diaphragm may be curved or have indentations or ridges, so that the first plane may be a symmetry plane, a lower plane, an upper plane, a plane in which the diaphragm is supported, such as at its edges, or the like.

The sensor has a housing. The sensor also preferably is a miniature device, such as a device with an overall volume of 10 mm3 or less.

If the sensor is a microphone, the microphone housing may have a microphone housing wall part comprising a sound input. The microphone housing usually has an inner volume into which the sound input opens from the outside of the housing. Any technology may be used in the microphone housing to convert the sound received into an output signal.

As is the situation in the receiver situation, the sound input may be provided in a substantially flat or plane wall portion. Other shapes may be desired of the wall portion or the microphone.

Preferably, the wall portion, in which the sound input is provided, is at least substantially parallel to the wall portion in which the sound output is provided. In addition or alternatively, the sound input and sound output may be positioned in a common plane and/or close to each other, such as with a distance between them of no more than a smallest dimension of the receiver housing.

In one situation, the same opening in the receiver housing may be used for outputting sound and receiving sound, where the microphone is provided inside the receiver housing and has an opening (or a sound guiding element) configured to receive sound from the common opening.

In a particular example, the microphone may be configured to detect the sound generated by and in the receiver housing so that it is not desired to sense sound received from outside of the receiver housing.

Further, preferably, the two wall portions are directed in at least substantially the same direction so that the sound is emitted toward a direction from which sound may be received. In this manner, the assembly may be provided inside an ear of a person so that sound is emitted toward the ear drum and sound from the ear canal may be received.

According to one aspect of the invention:

the receiver housing and sensor housing overlap at least partly when projected on to a first plane, and the receiver housing and sensor housing overlap at least partly when projected on to a plane perpendicular to the first plane.

In this context, the first plane may be a plane defined by the receiver diaphragm, but this is not required.

In this context, a housing will define an area or outer contour when projected on to a plane. An overlap in that plane thus is seen when the areas or contours of the two housings overlap.

When the two housings overlap in the two projections, the overall extent of the assembly may be made smaller, which has advantages, such as if it is desired to position the assembly inside the ear canal of a person.

In a first preferred embodiment, the sensor housing is positioned at least partly inside the receiver housing. Thus, the sensor housing may have an outer wall portion taking part in defining a chamber in the receiver housing.

If the sensor is a microphone, the wall portion of the microphone housing comprising the sound inlet may be positioned outside of the receiver housing, such as if the receiver housing has an opening closed or sealed by the microphone housing.

Alternatively, the sensor housing may be provided completely within the receiver housing. In that situation, the sensor may be positioned at any desired position in the receiver.

If the sensor is a microphone, the receiver preferably has a sound entrance in the housing wall part, where the microphone is positioned so that the sound input may receive sound from the sound entrance. Then, sound may still be received by the microphone. The relative positioning may be, for example, so that the sound inlet and the sound entrance overlap when projected on to a plane, such as a plane perpendicular to the wall part comprising the sound entrance.

Preferably, the sound entrance, if present, and the sound output are provided in the same, preferably flat, wall portion of the receiver housing. It may actually be the same opening. Alternatively, the wall parts comprising the sound output and the sound inlet may be positioned close to each other. In general, this may make it easier to engage the two openings with e.g. a spout, which is described further below.

Naturally, a sound entrance may be provided in the receiver housing and a sound guide provided to guide received sound to the microphone inlet. The receiver housing and/or microphone housing may form a part of the sound guide if desired.

When the sensor is positioned inside the receiver housing, it will affect the overall volume and thus the properties of the receiver. Thus, it may be desired that the sensor is rather small. In one embodiment, it is desired that the sensor housing has an outer volume not exceeding 20%, such as not exceeding 10% or even not exceeding 5%, of an inner volume of the receiver housing. Usually, the receiver has a front chamber, into which the sound outlet opens, and a second chamber on an opposite side of the diaphragm. In that situation, the sensor may be provided in the second chamber and take up no more than 20%, such as no more than 15%, such as no more than 10%, such as no more than 8% of a volume of the second chamber.

In one situation, the sensor housing is box-shaped and has 6 outer wall portions, which are pair-wise parallel. Often, the sensor has rounded corners and edges. In this situation, the sensor housing may be selected so that a wall portion with a largest surface area has a surface area not exceeding two, such as not exceeding 1.8, such as not exceeding 1.5, such as not exceeding 1.3, times a surface area of a wall portion having the smallest surface area. In the situation where all wall portions have the same size would be the shape of a cube. In this context, the area of a wall portion may be that defined by the wall portion when projected on to a plane perpendicular to the wall portion or a portion of the wall portion.

In this situation, it is not desired to have e.g. a long and flat sensor housing, as the sensor housing, positioned in the receiver housing, may be exposed to very high sound pressures which may deform or vibrate too large wall parts of the sensor.

On the other hand, a certain inner volume is desired of the sensor housing, and thus, this more cube-shaped shape is preferred as it allows the desired inner volume while keeping the wall parts relatively small.

In addition or alternatively, vibration of the sensor housing wall parts may be prevented by providing relatively stiff or thick walls of the sensor housing such as walls with a thickness of at least 0.5 mm, such as at least 0.75 mm, such as at least 1.0 mm, such as at least 1.5 mm, such as at least 2 mm, such as at least 2.5 mm, such as at least 3 mm.

Another manner of providing a microphone with a stiffer casing is to add thereto outer plating or stiffening elements. The stiffening may be adding to the wall thickness or, for example, providing stiffening ribs or the like. In addition, a plate may be made more stiff when e.g. ribs or indents are added thereto or formed therein. Also, glue may be added to the housing to make it stiffer.

In another preferred embodiment, the sensor housing is positioned at least partly outside of the receiver housing. Then, at least a portion of the sensor housing extends outside of the receiver housing. In this embodiment, preferably all of the sensor housing is positioned outside of the receiver housing, such as when the sensor housing and the receiver housing do not share wall parts.

In one situation, the sensor housing is then attached to the receiver housing. This makes handling of the assembly easier, as they may be handled as one unit. The attachment may be via glue, welding, soldering, press fitting or the like. The attachment may be permanent or releasable.

Usually, the signal generated by the sensor is desired transported to other elements of the assembly or to which the assembly is connected, such as a processor, amplifier, circuit or the like. Thus, the sensor may comprise one or more electrically conducting elements on or at an outer surface thereof for delivering this output.

Also the receiver may have one or more electrically conducting elements on or at an outer surface thereof for receiving a signal to be converted into sound by the receiver.

The assembly may further comprise one or more conductors connected to the sensor housing, such as the above electrically conducting elements, in order to e.g. receive a signal. Such conductors will then extend outside of the sensor housing but will preferably extend, at least for a portion of a length thereof, inside the receiver housing, such as to electrically conducting elements on or at an outer surface of the receiver housing so that the signal from the sensor may be delivered to such conducting elements, via the conductors. Then, the conductors may be at least partly protected by extending inside the receiver housing. In one situation, the electrically conducing elements of the microphone may be provided in a wall portion of the sensor housing facing a wall portion of the receiver housing. This portion of the receiver housing may comprise, as a portion of the conductors, electrically conducting elements to which the conducting elements of the microphone housing are connected.

In this context, the conductors may extend within the inner volume of the housing or e.g. within the housing walls thereof.

In that situation, the connections for both the receiver and the sensor may be made to the receiver housing. The electrically conducting elements for these connections may be provided in the same wall portion of the receiver housing, such as a wall portion opposite to a wall portion in which the sound output is provided.

Naturally, alternatively, the conductors for the sensor may simply extend around the receiver housing and away therefrom.

In general, the sensor may be a microphone comprising a microphone diaphragm being at least substantially perpendicular to a main direction of vibration of the receiver. Depending on the type of receiver, this direction may be perpendicular to the receiver diaphragm, or even parallel thereto. Often, a microphone diaphragm will define, with an inner surface of the microphone housing, a second chamber in the microphone housing, the microphone diaphragm being positioned within a second plane which may then be at least substantially perpendicular to the vibration direction or plane.

During operation, the receiver diaphragm may cause vibrations which will often be in a direction perpendicular to the first plane. Such vibrations may affect the operation of the microphone, if the connection between the microphone and receiver is not very soft. An undesired cross talk is seen when the vibration of the receiver diaphragm causes a vibration of the microphone diaphragm, as this will add a signal to the output of the microphone which is not caused by sound received.

One manner of avoiding, at least to a certain degree, this cross talk is to orientate the microphone so that the microphone diaphragm is at least substantially perpendicular to the vibrations caused by the receiver diaphragm, so that the major vibration caused by the receiver diaphragm causes a translation and not a vibration or deformation of the microphone diaphragm.

In one embodiment, the receiver diaphragm and sensor housing overlap at least partly when projected on to the first plane. In that situation, the receiver diaphragm need not be limited by the presence of the sensor which may extend in a chamber of the receiver, such as "under" the receiver diaphragm. The size of the diaphragm is a factor in the definition of the maximum sound intensity which the receiver may output, and it is usually desired to provide as large a diaphragm as practically possible.

In one embodiment, the receiver housing and sensor housing, when projected on to the first plane, overlap an area of at least 10%, such as at least 20%, such as at least 40%, such as at least 50%, such as at least 75%, such as at least 90%, such as 100% of an area of the microphone housing in the projection.

Alternatively or additionally, the receiver housing and sensor housing, when projected on to the plane perpendicular to the first plane, overlap an area of at least 10%, such as at least 20%, such as at least 40%, such as at least 50%, such as at least 75%, such as at least 90%, such as 100% of an area of the sensor housing in the projection.

Alternatively or additionally, the receiver diaphragm and sensor housing, when projected on to the first plane, overlap an area of at least 10%, such as at least 20%, such as at least 40%, such as at least 50%, such as at least 75%, such as at least 90%, such as 100% of an area of the sensor housing in the projection.

In the situation where the microphone is provided in the receiver housing then having a sound entrance, the spout or sound guide may then engage this sound entrance instead of the sound inlet.

In one embodiment the sensor is a microphone with a SNR (signal-to-noise ratio) of no more than 63 dB. This low SNR is useful in situations where the sound pressure is very high, such as between a hearing aid and an ear canal or an eardrum.

The SNR may be even lower, such as no more than 61 dB, such as no more than 60 dB, such as no more than 59 dB, such as no more than 58 dB, such as no more than 57 dB, such as no more than 55 dB, such as no more than 53 dB, such as no more than 51 dB.

Another aspect of the invention relates to an assembly of a receiver and a microphone, where the microphone has a SNR of no more than 63 dB. Naturally, the microphone may be as described above. The assembly may be configured to, such as comprise means for, emit sound in a desired direction and receive sound from that direction. In one embodiment, the assembly may have a surface, such as a surface perpendicular to the desired direction, in which a sound input for the microphone and a sound output for the receiver is positioned.

It is noted that sound guide(s) may be provided for directing sound to the desired direction from the receiver and/or from the desired direction to the microphone.

Naturally, all aspects, embodiments, situations and advantages of the invention may be combined.

Another aspect of the invention relates to an assembly of a microphone and a receiver wherein a particular orientation is selected of the microphone diaphragm in relation to the receiver diaphragm. This aspect relates to an assembly of a receiver and a microphone, wherein:

the receiver comprises:

a receiver housing, a receiver diaphragm defining, with an inner surface of the receiver housing, a first chamber in the receiver housing, the receiver diaphragm being positioned within a first plane, the microphone comprises:

a microphone housing attached to the receiver housing, a microphone diaphragm defining, with an inner surface of the microphone housing, a second chamber in the microphone housing, the microphone diaphragm being positioned within a second plane at least substantially perpendicular to the first plane.

Naturally, all the embodiments and situations of the above and below aspects may be combined and interchanged. The advantages of the aspects thus may be combined in any manner.

A final aspect of the invention relates to an assembly of the types mentioned above where the microphone is electrically connected to via conductors extending through the receiver. This aspect relates to an assembly of a receiver and a microphone, wherein:

the receiver has a receiver housing and one or more first electrically conducting portions exposed on the outside of the receiver housing, the microphone has a microphone housing and one or more second electrically conducting portions exposed on the outside of the microphone housing, the microphone housing being provided outside of the receiver housing, one or more electrical conductors are provided, each electrical conductor electrically connecting a first conducting portion and a second conducting portion, at least a portion of an electrical conductor extending within the receiver housing.

Again, this aspect may be combined with any of the features of the above aspects and embodiments of the invention in order to e.g. combine the advantages thereof.

BRIEF DESCRIPTION OF THE DRAWINGS

In the following, preferred embodiments are described with reference to the drawing, wherein.

DETAILED DESCRIPTION OF THE INVENTION

Figure 1:
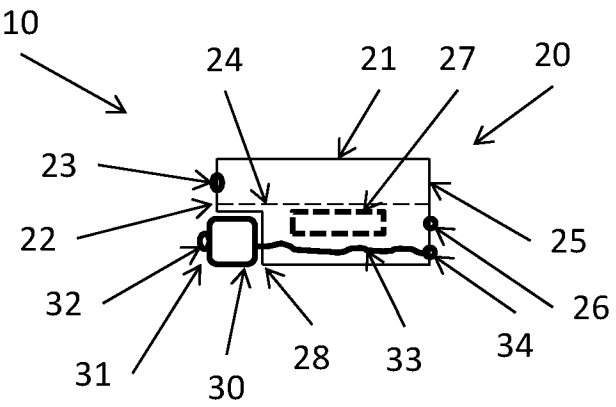
FIG. 1 illustrates a first embodiment according to the invention.

In FIG. 1, an assembly 10 is illustrated comprising a receiver 20 with a receiver housing 21 having a first wall surface 22 with a sound output 23 and a second wall surface 25 with an electrically conducting pad 26 which may be used for feeding a signal to a motor (indicated by square 27) configured to drive a diaphragm 24 to generate sound to be output by the output 23.

As is standard in receivers especially for hearing aid applications or hearables, the receiver diaphragm 24 divides an inner volume of the housing 21 into two chambers: a first chamber above the diaphragm 24 into which the sound output opens, and a second chamber below the diaphragm 24.

The housing 20 has a lower indentation or cavity 28 in which a microphone 30 is positioned. The microphone 30 has a front wall portion 31 in which a sound inlet 32 is provided.

The microphone 30 is configured to receive sound and output a corresponding signal to electrical conductors 33 extending within the receiver housing 21 and to conducting pads 34 provided on the wall part 25. Thus, the connection for both the microphone and receiver takes place at the same wall part, here opposite to the wall parts 22 and 31, of the assembly. Also, the wires 33 are protected within the housing 21 and thus are much less prone to damage during e.g. mounting within a hearing aid or hearable.

The present assembly is well suited for use in ear canals, such as for hearing aids or hearables, where the sound output of the sound output is fed toward the ear drum and where the microphone is configured to receive sound from the space between the eardrum and the assembly. The output of the microphone may be used for controlling the receiver.

The overall dimensions of the assembly may be made to fit inside an ear canal, as the presence or addition of the microphone need not increase the overall dimensions, especially in the up/down direction and the direction out of the drawing, of the assembly.

It has been found that providing the cavity 28, even though it may reduce the overall volume of especially the second chamber of the receiver, when the width, length and depth thereof are maintained (that the cavity 28 is created within the usual dimensions of the receiver), will reduce the sensitivity of the receiver only to an acceptable degree. In FIG. 1, the front chamber may have the "usual" dimensions and volume, but the second chamber may be reduced up to e.g. 10% with only a small and acceptable reduction in sensitivity.

In a Sonion 3500 type receiver having an outer length of 7.84 mm, an inner length (of the inner chamber) of 7.50 mm, an outer width of 4.06 mm, an inner width of 3.72 mm, an outer height of 2.57 mm and an inner height of 2.40 mm (giving, assuming a box shape, an outer volume of 81.80 mm3 and an inner volume of 66.96 mm3), the second chamber has a length of 7.50 mm, a width of 3.72 mm and a height of 2.07 mm (and thus a volume of 57.75 mm3).

A motor 27 may be provided in the second chamber with an overall volume of 20.81 mm3 allowing a remaining volume of the second chamber of 36.94 mm3.

Microphones may be extremely small. A TDK4064 has a length of 2.70 mm, a width of 1.60 mm and a height of 0.89 mm giving a volume (assuming a box shape) of only 3.84 mm3. A Cirrus CS7331 microphone has a length of 2.50 mm, a width of 1.60 mm and a height of 0.90 mm giving a volume (box-shape assumption) of 3.60 mm3.

In a Sonion 3500 receiver, a 20% reduction of the volume of the second chamber results in a low frequency loss (at 100 Hz) of 1.5-2 dB. Actually, if a sensitivity loss of 5 dB is acceptable, the second volume may be reduced by about 45%.

It is noted that the motor 27 may need redesigning in order to take up less of the length of the receiver.

Figure 2:
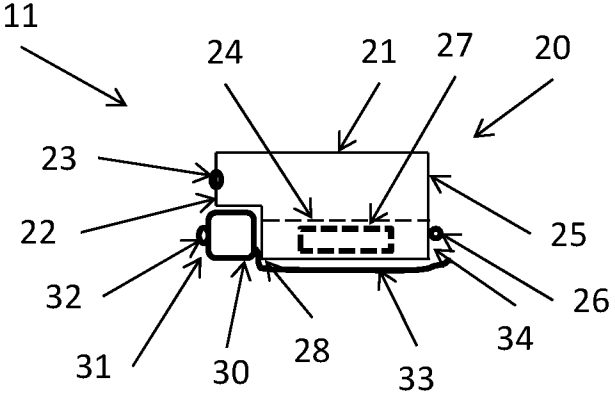
FIG. 2 illustrates a second embodiment according to the invention.

In the assembly 11 of FIG. 2, compared to the assembly 10 of FIG. 1, the wires 33 are provided outside of the housing 21. Also, it is seen that the second chamber can be smaller, as the diaphragm 24 is now limited by the cavity 28.

Figure 3:
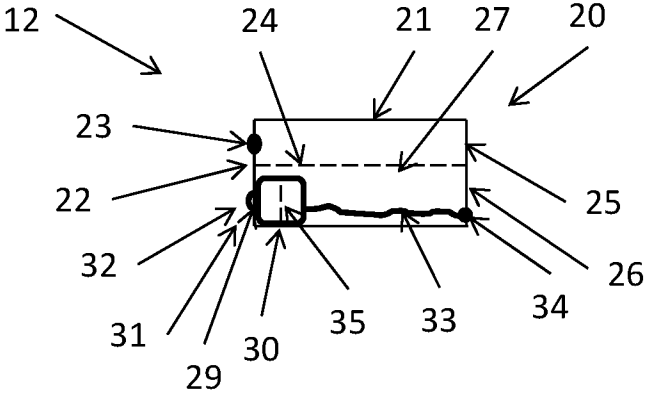
FIG. 3 illustrates a third embodiment according to the invention.

In the assembly 12 of FIG. 3, compared to the assembly 10 of FIG. 1, the microphone 30 is now provided in the second chamber. Then, a sound entrance 29 is provided in the wall part 22 in order to allow sound to enter the housing 21 and the sound inlet 32 of the microphone.

Again, the volume of the second chamber is reduced, but as described above, this is acceptable.

However, in this embodiment, the microphone 30 is provided inside the receiver 20 and thus exposed to the sound pressure created in the receiver. For this reason, it is desired to select a microphone which is able to withstand that situation.

One manner of rendering a microphone more resistant to high sound pressures is to provide the microphone with a stiffer housing, such as by providing a housing with a larger wall thickness. Another manner is to select a housing shape which is less prone to vibrate. Vibrations of wall parts will travel to the sensitive portion of the microphone and create a false signal. The larger the area of the wall, the more easily is it vibrated or deformed. On the other hand, a microphone should have a certain inner volume. Thus, a more cube-shaped or dice shaped microphone would have generally more evenly sized wall parts, so that no wall parts are more prone to vibrate than others.

A third aspect has to do with the vibrations created by the diaphragm 24. These vibrations primarily are in a direction perpendicular to the plane of the diaphragm 24. Thus, the sensitive portion of the microphone may be directed so as to be sensitive in other directions. In FIG. 3, the sensitive portion of the microphone 30 is a diaphragm 35 which is positioned in a plane perpendicular to that of the receiver diaphragm 24 so that vibrations of in the plane of the diaphragm 35 will translate the diaphragm 35 without deforming it.

Figure 4:
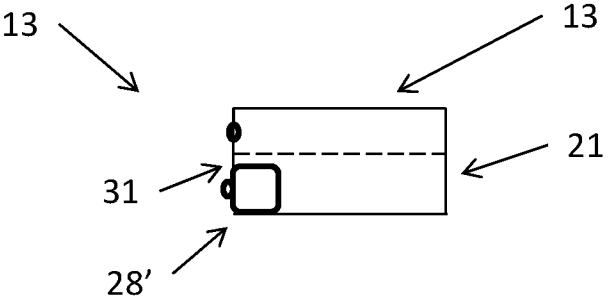
FIG. 4 illustrates a fourth embodiment according to the invention.

In the assembly 13 of FIG. 4, the microphone 30 is positioned only partly within the housing 21 in that the wall part 31 of the microphone 30 forms an outer surface of the assembly. Thus, an opening 28' of the housing 21 is sealed by the microphone 30 so that no sound entrance 29 is required.

Clearly, in FIGS. 1 and 2, the microphone 30 needs not be positioned in a cavity 28 which may take up the total overall dimensions of the microphone 30. The cavity 28 may be made smaller so that the microphone will extend out of the cavity 28. When projected on to the plane of the diaphragm 24, the receiver housing and the microphone housing will overlap to at least some degree in order to have lower overall dimensions compared to when the housings do not overlap in that projection.

The same is the situation when projected on to a plane perpendicular to the plane of the diaphragm 24, such as a plane perpendicular to the plane of the figure. Also in that situation, an overlap is seen in the projection—for the same reasons.

Figure 5:
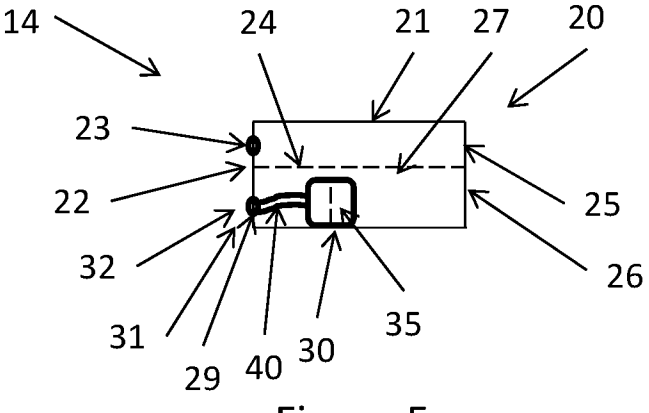
FIG. 5 illustrates a fifth embodiment according to the invention.

In FIG. 5, an embodiment 14 is seen where the microphone 30 is provided inside the receiver housing and where a sound tube 40 is provided for guiding sound from the sound entrance 29 to the microphone sound input 32. Then, the microphone may be positioned anywhere in the receiver housing.

The sound tube 40 may be a separate element. The sound tube may be replaced by a sound guide which may be completely or partly formed by portions of the inner surface of the receiver housing and portions of the outer surface of the microphone.

Figure 6:
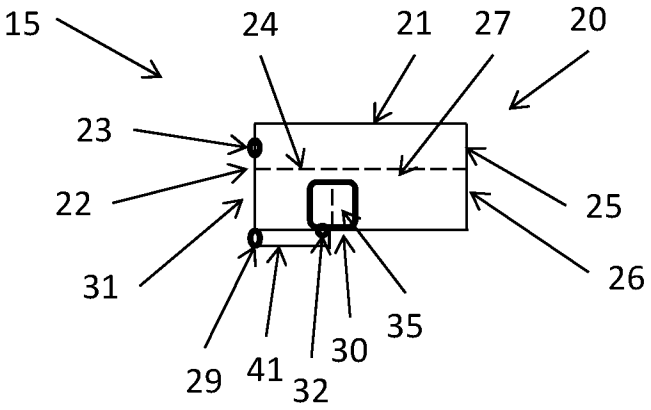
FIG. 6 illustrates a sixth embodiment according to the invention.

In FIG. 6, an embodiment 15 is illustrated where the sound entrance 29 is formed outside of the receiver housing by an external element 41 also configured to guide the sound received to the microphone, where an opening may be made in the receiver housing to allow the sound to enter the receiver housing and be transported to the microphone.

The same is the situation in the other embodiments. Naturally, the overlap is 100% when the microphone is positioned completely within the receiver housing.

Also, it is seen that the sensor, such as a microphone, may be positioned both outside of the receiver housing as well as inside the receiver housing without having to alter the position or dimensions of the diaphragm (compared to the same receiver without the microphone therein) or without providing the receiver with the cavity 28 but maintaining the motor and dimensions of the first chamber and the diaphragm.

Then, a standard or existing receiver may be provided with a microphone therein and with a sound entrance allowing sound to enter the microphone. This receiver now is an assembly according to the invention and, with a small and acceptable low frequency sensitivity drop, gains additional capabilities.

It is noted that small microphones have a lower sensitivity compared to larger microphones. This, however, is not an issue, as the sound pressure which the present microphone is to sense especially in the inner ear situation, is very high. Thus, the advantage of the lower sensitivity acts together with the advantage of the lower volume of the microphone.

Thus, the present assembly may be used, as described, in a hearing aid or hearable. Naturally, such hearing aid or hearable may comprise other elements, such as a battery, antenna or coil, processor, amplifier, other circuits, or the like.

The invention claimed is:

1. An assembly comprising a sensor and a receiver, wherein:

the receiver comprises:

a receiver housing with a receiver housing wall part comprising a sound output, the receiver housing having a largest dimension of no more than 10 mm, a receiver diaphragm defining, with an inner surface of the receiver housing, a first chamber in the receiver housing, the sensor comprises a sensor housing, the receiver housing and sensor housing overlap at least partly when projected on to a first plane, and the receiver housing and sensor housing overlap at least partly when projected on to a second plane perpendicular to the first plane, wherein the sensor housing is positioned at least partly outside of the receiver housing.

2. An assembly according to claim 1, wherein the sensor housing is positioned at least partly inside the receiver housing.

3. An assembly according to claim 2, wherein the sensor housing has an outer volume not exceeding 20% of an inner volume of the receiver housing.

4. A receiver according to claim 1, wherein the receiver has a sound output in the housing wall part, where the sensor is a microphone positioned so that the sound input may receive sound from the sound output.

5. A receiver according to claim 1, wherein the sensor housing is box-shaped and has 6 outer wall portions, where a wall portion with a largest surface area has a surface area not exceeding twice a surface area of a wall portion having the smallest surface area.

6. An assembly according to claim 1, wherein the sensor housing has a wall thickness of at least 0.5 mm.

7. An assembly according to claim 1, wherein the sensor housing is attached to the receiver housing.

8. An assembly according to claim 1, further comprising one or more conductors connected to the sensor housing and extending outside of the sensor housing, at least a part of the conductor(s) extending inside the receiver housing.

9. An assembly according to claim 1, wherein the sensor is a microphone comprising a microphone diaphragm being at least substantially perpendicular to a main direction of vibrations caused by the receiver.

10. An assembly according to claim 1, wherein the receiver diaphragm and sensor housing overlap at least partly when projected on to a first plane.

11. An assembly according to claim 1, wherein the receiver housing and sensor housing, when projected on to a first plane, overlap an area of at least 10% of an area of the sensor housing in the projection.

12. An assembly according to claim 1, where the microphone has a SNR of no more than 63 dB.

13. An assembly according to claim 1, wherein the receiver housing and sensor housing, when projected on to a first plane, overlap an area of at least 10% of an area of the microphone housing in the projection.

14. An assembly according to claim 1, wherein the receiver housing and sensor housing, when projected on to a first plane, overlap an area of at least 20% of an area of the microphone housing in the projection.

15. An assembly according to claim 1, wherein the receiver housing and sensor housing, when projected on to a first plane, overlap an area of at least 50% of an area of the microphone housing in the projection.

16. A hearing aid comprising a receiver and a microphone, where the receiver of the hearing aid has a largest dimension of no more than 10 mm and is configured to output sound, and where the microphone has a SNR of no more than 63 dB.

17. An assembly comprising a receiver and a sensor, wherein:

the receiver comprises:

a receiver housing having a largest dimension of no more than 10 mm, a receiver diaphragm defining, with an inner surface of the receiver housing, a first chamber in the receiver housing having a sound output, and a second chamber in the receiver housing, the sensor comprises a sensor housing being inside the second chamber, and the sensor housing or its portion inside the second chamber, having a volume not exceeding 20% of a volume of the second chamber.

18. An assembly according to claim 17, wherein the sensor is a microphone.

19. An assembly according to claim 17, wherein the second chamber is a closed chamber.

20. An assembly according to claim 18, wherein:

the receiver housing comprises a wall portion comprising a sound output, the first chamber being at one side of the diaphragm and the second chamber being on an opposite side of the diaphragm, the microphone housing being provided inside the second chamber, and the receiver housing comprises a sound entrance via which the microphone may receive sound, the sound entrance being provided in the wall portion, in which the sound input is provided.

* * * * *